US005480132A

United States Patent [19]

Kiyohara et al.

[11] Patent Number: 5,480,132

[45] Date of Patent: Jan. 2, 1996

[54] SHEET TRANSPORT APPARATUS WITH DISENGAGEMENT MEANS TO ALLOW REVERSE SHEET MOVEMENT

[75] Inventors: Takehiko Kiyohara, Zama; Tetsuhiro Nitta, Yokohama, both of Japan

[73] Assignee: Canon Kabushiki Kaisha, Tokyo, Japan

[21] Appl. No.: 432,596

[22] Filed: May 1, 1995

Related U.S. Application Data

[63] Continuation of Ser. No. 70,808, Jun. 3, 1994, abandoned.

[30] Foreign Application Priority Data

Jun. 29, 1992 [JP] Japan ..... 4-171086
Jul. 6, 1992 [JP] Japan ..... 4-201945

[51] Int. Cl.[6] ..... B65H 5/00

[52] U.S. Cl. ..... 271/10.01; 271/10.09; 271/114; 271/225

[58] Field of Search ..... 271/10.01, 10.09, 271/114, 225

[56] References Cited

U.S. PATENT DOCUMENTS 4,929,105 5/1990 Hirayama et al. ..... 271/225 X
5,169,136 12/1992 Yamagata et al. ..... 271/10
5,238,235 8/1993 Nitta et al. ..... 271/9

FOREIGN PATENT DOCUMENTS 3102023 4/1991 Japan .

*Primary Examiner*—David H. Bollinger
*Attorney, Agent, or Firm*—Fitzpatrick, Cella, Harper & Scinto

[57] ABSTRACT

A sheet transport apparatus has a transport mechanism for transporting a sheet-like member in a predetermined direction and in a direction reverse to the predetermined direction, an auxiliary transport roller capable of contacting with the sheet transported by the transport mechanism, a motor, and a drive transmission mechanism arranged to transmit a driving force for rotating the auxiliary transport roller in a direction such as to transport the sheet in the predetermined direction from the motor to the roller when the transport mechanism transports the sheet in the predetermined direction, and to disengage the connection to the motor to enable the auxiliary transport roller to rotate by following the sheet.

37 Claims, 11 Drawing Sheets

SHEET TRANSPORT APPARATUS WITH DISENGAGEMENT MEANS TO ALLOW REVERSE SHEET MOVEMENT

This application is a continuation of application Ser. No. 08/070,808, filed Jun. 3, 1994, now abandoned.

BACKGROUND OF THE INVENTION

1. Field of the Invention

This invention relates to a sheet transport apparatus for transporting a sheet-like member.

2. Description of the Related Art

Japanese Patent Laid-Open Publication Hei 3-102023 discloses a recording apparatus in which an auxiliary transport roller assembly is provided between a sheet feed section and a printing/transport section. The auxiliary transport roller assembly has no pinch roller and a sheet surface is brought into contact with an auxiliary transport roller surface by the resiliency of the sheet in a bent state whereby the recording sheet is transported.

However, if the sheet feed angle (to a horizontal plane) at which the sheet is transported from the sheet feed section to the printing section in this conventional apparatus is small, the resiliency force of the sheet produced by bending is reduced so that the sheet cannot be transported by the auxiliary transport roller assembly. The arrangement and construction of components of the apparatus are therefore restricted.

If a pinch roller facing the auxiliary transport roller assembly is provided to forcibly transport the sheet, an error is caused in the reverse movement of the sheet in accordance with a predetermined printing mode by the influence of the transporting force of the auxiliary transport roller assembly, resulting in occurrence of defects such as white or black lines in a printed image.

This printing mode will be described below with reference to FIG. 6.

In FIG. 6, a distance P represents a line feed pitch, a symbol □ represents a printing area, and a numeral in □ (a numeral shown next to □ in sentences of this description) represents printing order. In a case where enlarged characters I, J, K, and L are printed after printing ordinary size characters A, B, . . . G, and H , line □1 is printed first, the sheet is then fed a distance P, and line □2 is printed. Thereafter, the sheet is fed a distance P/2 in the reverse direction and line □3 is then printed. If the value of P/2 is greater than the predetermined value, a white line is formed at the center of the enlarged characters, as shown in the letters J and K. If the value of P/2 is smaller than the predetermined value, a black line is formed at the center of the enlarged characters, as shown in the letters K and L. Some black line may be allowed but any white line is unallowable because it considerably reduce the quality of character prints.

That is, since the sheet movement in the normal direction is effected for a line change, the influence of the accuracy of the sheet movement upon the printed character area is small but the influence of the accuracy of the sheet movement in the reverse direction upon the printed character area is large.

Recording sheets used in the recording apparatus include ordinary paper, thick sheets or layers of paper, such as in postcards and envelops, and special sheets, such as thin plastic sheets.

Recording sheets are manually inserted or automatically supplied in such a manner that a plurality of recording sheets are set together and transported one after another by an automatic sheet feeder.

Recording sheets are guided by a guide member, which limits the number of sheets, to be set inside a separating claw without contacting a feed roller.

The above-described recording apparatus is ordinarily arranged in such a manner that recording sheets are supplied by being separated one after another by the rotation of the feed roller of the automatic sheet feeder, and, after recording, are stacked in a sheet discharge section by a sheet discharge roller provided downstream of a transport roller. An automatic feeder arranged to eliminate a back tension of the feed roller has also been proposed in which the feed roller has a semicircular cross section such as to avoid contact with a recording sheet.

In the conventional automatic sheet feeder, however, recording sheets may contact the semicircular feed roller when brought close to the feed roller to be set, because there is a variation in the initial angular position of the feed roller or because of instability of recording sheets. In the worst case, the feed roller rotates by following the recording sheets by a frictional force, so that the recording sheets cannot be set smoothly. There is also a possibility of a sheet feeding failure if the position of the feed roller is incorrect.

To avoid such problems, the extent of overlapping between the feed roller and the sheet number limiting guide member may be increased. In this case, however, the number of set sheets is necessarily reduced or the capacity of the sheet container is necessarily increased.

SUMMARY OF THE INVENTION

In view of these circumstances, an object of the present invention is to provide a sheet transport unit in a recording apparatus in which a sheet feed angle can be freely set and in which reverse sheet feeding is performed accurately to achieve high-quality recording.

Another object of the present invention is to provide a small, low-priced and high-quality automatic sheet feeder capable of preventing driven rotation of a feed roller caused by contact between recording sheets and the feed roller when the recording sheets are set.

To achieve these objects, according to the present invention, there is provided a sheet transport apparatus comprising transport means for transporting a sheet in a predetermined direction and in a direction reverse to the predetermined direction, a rotating member capable of contacting with the sheet transported by the transport means, a drive source, and drive transmission means arranged to transmit a driving force for rotating the rotating member in a direction such as to transport the sheet in the predetermined direction from the drive source to the rotating member when the transport means transports the sheet in the predetermined direction, and to cancel the connection to the drive source to enable the rotating member to rotate by following the sheet.

In still another aspect of the invention there is provided a sheet transporting apparatus comprising a drive source for generating a torque in a first direction and a torque in a second direction reverse to the first direction, a transport means for transporting a sheet in a forward direction by receiving torque in the first direction from the drive source and for transporting the sheet in a reverse direction by receiving the torque from the drive source in the second direction. These is also provided a rotating member contactable with the sheet transported by the transport means and drive transmission means for transmitting the torque in the first direction from the drive source to rotate the rotating member so as to transport the sheet in the forward direction, the drive transmission means disengaging from the rotating member when torque in the second direction is transmitted.

These and other objects and features of the present invention will become apparatus from the following detailed description of the invention.

DESCRIPTION OF THE PREFERRED EMBODIMENTS

Embodiments of the present invention will be described below with reference to the accompanying drawings.

Figure 1:
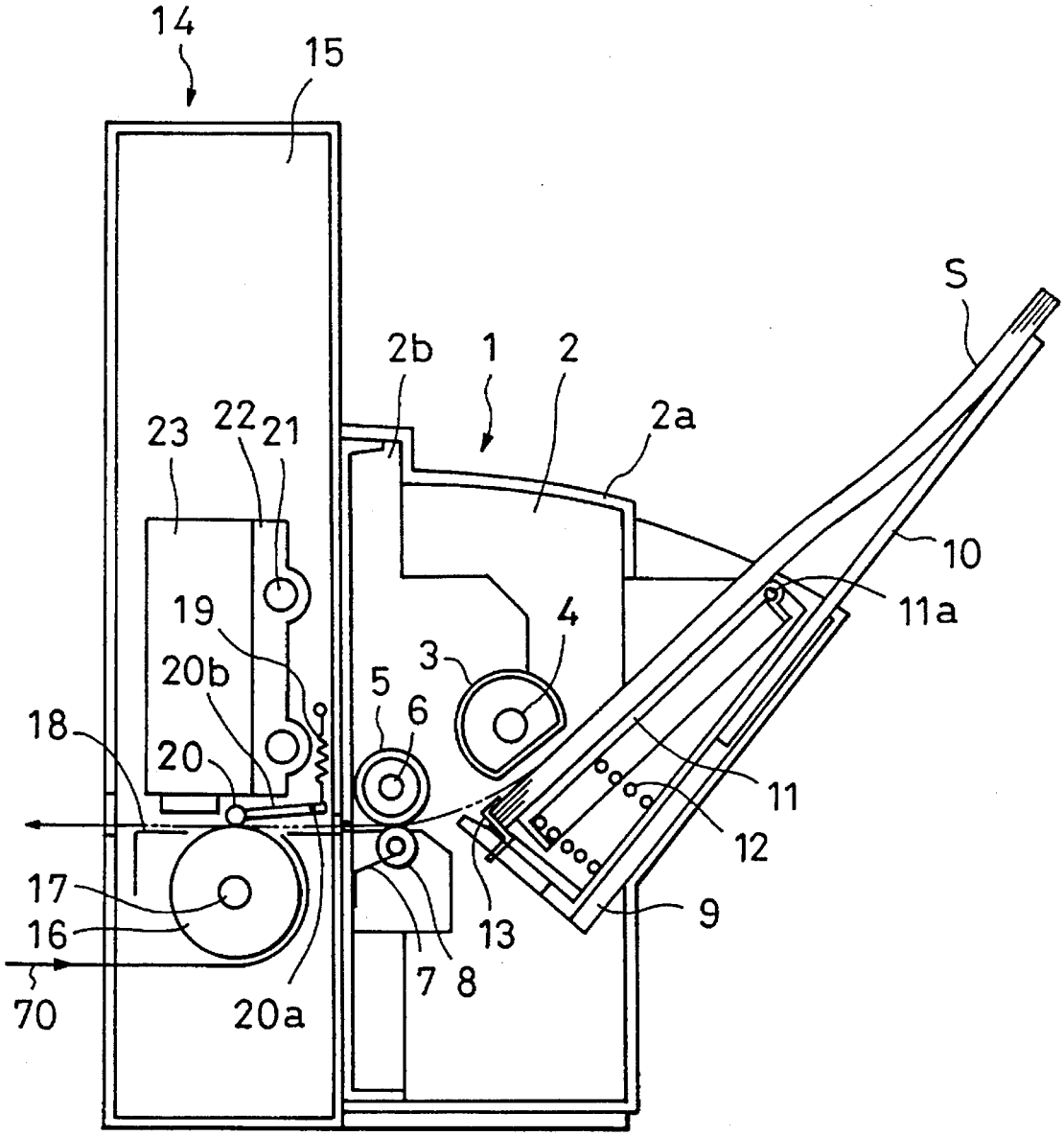
FIG. 1 is a longitudinal cross-sectional view of a recording apparatus in accordance with a first embodiment of the present invention.
Figure 2:
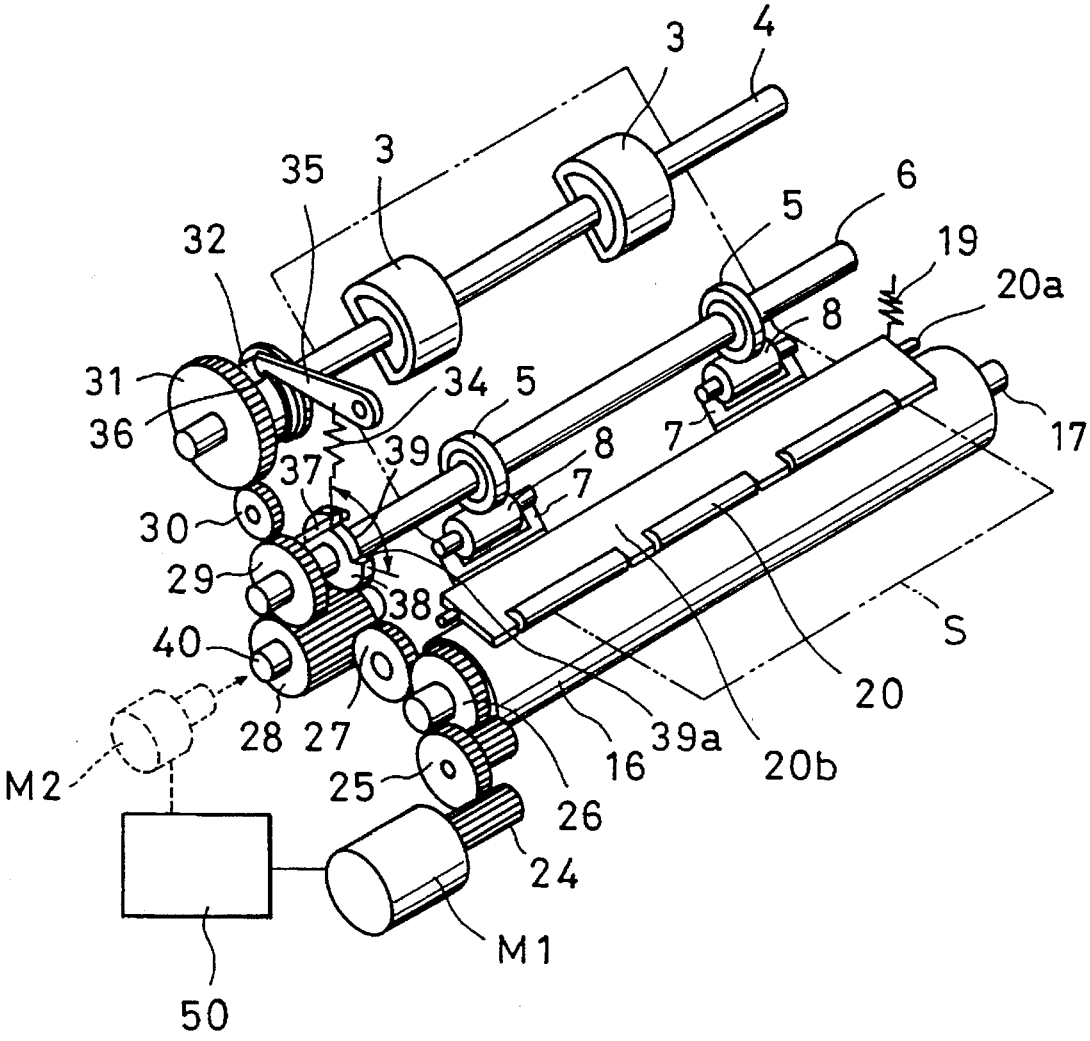
FIG. 2 is a perspective view of the sheet conveying components of the recording apparatus.

FIG. 1 is a longitudinal sectional view of a recording apparatus in accordance with an embodiment of the present invention, and FIG. 2 is a perspective view of essential components of the apparatus.

A body 2 of a sheet feeder unit 1 has a body cover 2*a* and a fore side plate 2*b* fixed at the downstream side of the body cover 2*a*. In the body 2 are disposed feed rollers (sheet feed means) 3, a supporting shaft 4 on which the feed rollers 3 are fixed, auxiliary transport rollers 5 for transporting each of sheets S supplied to these rollers after being separated by separating claws 13 and feed rollers 3, a supporting shaft 6 on which the auxiliary transport rollers 5 are supported, and pinch rollers 8 supported on plate springs 7.

In the body 2 are also disposed a hopper 9 for storing and holding sheets S, a sheet support 10, a pressure plate 11 rotatably supported by a shaft 11*a* on the hopper 9, a pressing spring 12 for pressing the pressure plate 11 against the feed rollers 3, the separating claws 13 provided on the pressure plate 11, and other components.

A recording unit (printing/transport unit) 14 has a body 15. In the body 15 are disposed a transport roller 16 for further transporting sheet S transported from the sheet feeder unit 1, a supporting shaft 17 on which the transport roller 16 is supported, a platen 18 for guiding sheet S, pressing rollers 20 which are attached to a free end of a supporting lever 20*b* pivotally supported on a supporting shaft 20*a* and urged toward the transport roller 16 by a spring 19, and which serves to press sheet S against the transport roller 16, a carriage 22 capable of reciprocal movement in the widthwise direction of sheet S while being guided by a plurality of guide shafts 21, a recording head (printing means) 23 mounted on the carriage 22 to perform printing in accordance with image information.

FIG. 2 is a schematic illustration of the sheet transport mechanism of this recording apparatus. In FIG. 2, the same components or components having the same functions as the components shown in FIG. 1 are designated with the same reference characters.

A motor M1 rotates the transport roller 16 on the basis of a control signal from a controller 50 through a motor gear 24, a two-stage gear 25, and a transport roller gear 26 fixed to the shaft 17. Torque from motor M1 is transmitted to a feed roller gear 31 through a gear 27 connected to the transport gear 26, a gear 28, an auxiliary roller gear 29 rotatably attached to the shaft 6, and a gear 30. Torque from feed roller gear 31 is transmitted to the feed rollers 3 through a one-revolution spring clutch 32 and the shaft 4.

The one-revolution spring clutch 32 incorporates a clutch spring. Each time the clutch 32 makes one revolution, an end of a lever 35 urged by a tensile force of a spring 34 is caught by a projection 36 formed on an outer cylinder of the one-revolution clutch 32 to stop the rotation of the same. The clutch spring is thereby loosened to inhibit the torque of the feed gear 31 in the sheet feeding direction from being transmitted to the feed rollers 3.

The end of the lever 35 is disengaged from the projection 36 of the one-revolution spring clutch 32 by a predetermined amount of rotation of the feed gear 31 in the direction opposite to the sheet feeding direction caused by the motor M1. Then, as the feed gear 31 is rotated in the sheet feeding direction, the spring clutch 32 is tightened so that the feed gear 31 and the shaft 4 are connected to enable the feed rollers 3 to rotate. A pin 37 embedded in the auxiliary roller gear 29 projects into a non-connection region 39 of a cut ring 38 fixed to shaft 6. The torque of the auxiliary roller gear 29 is not transmitted to the auxiliary transport rollers 5 in the range of the non-connection region 39.

Figure 4A:
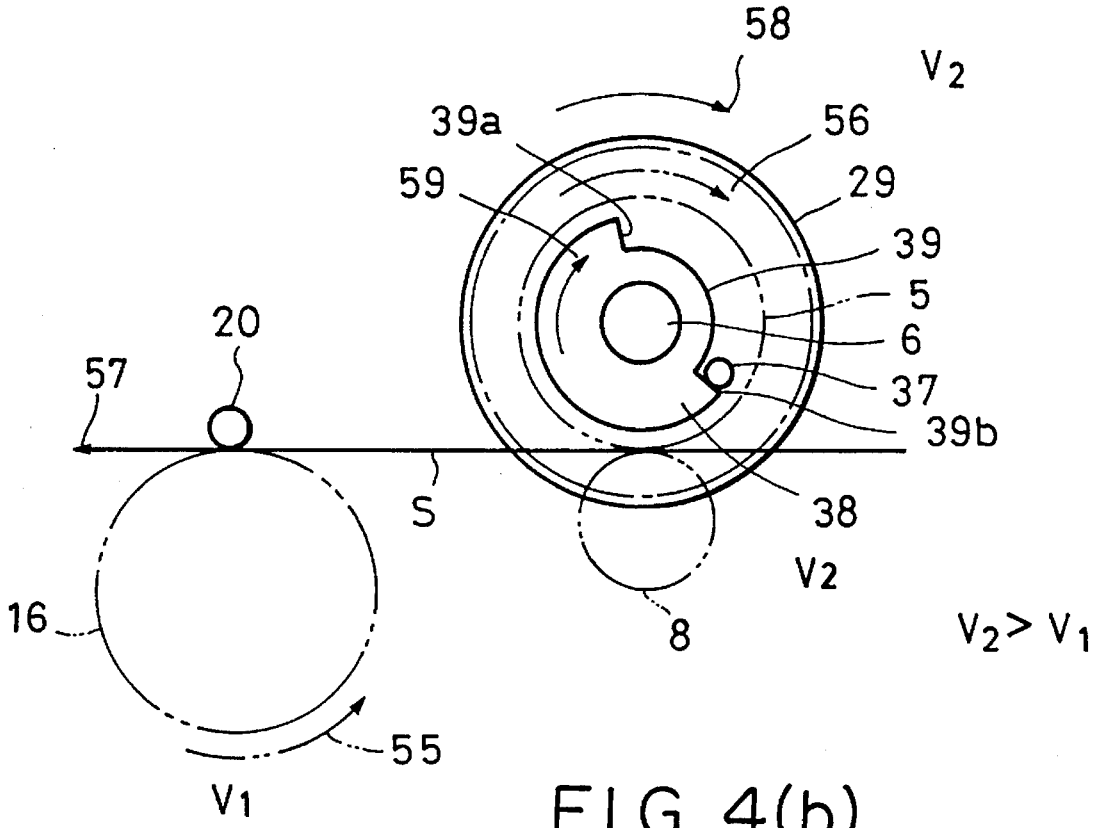
FIGS. 4(*a*) and 4(*b*) are schematic side views of the auxiliary transport roller, the cut ring and the transport roller in accordance with the first embodiment.
Figure 4B:
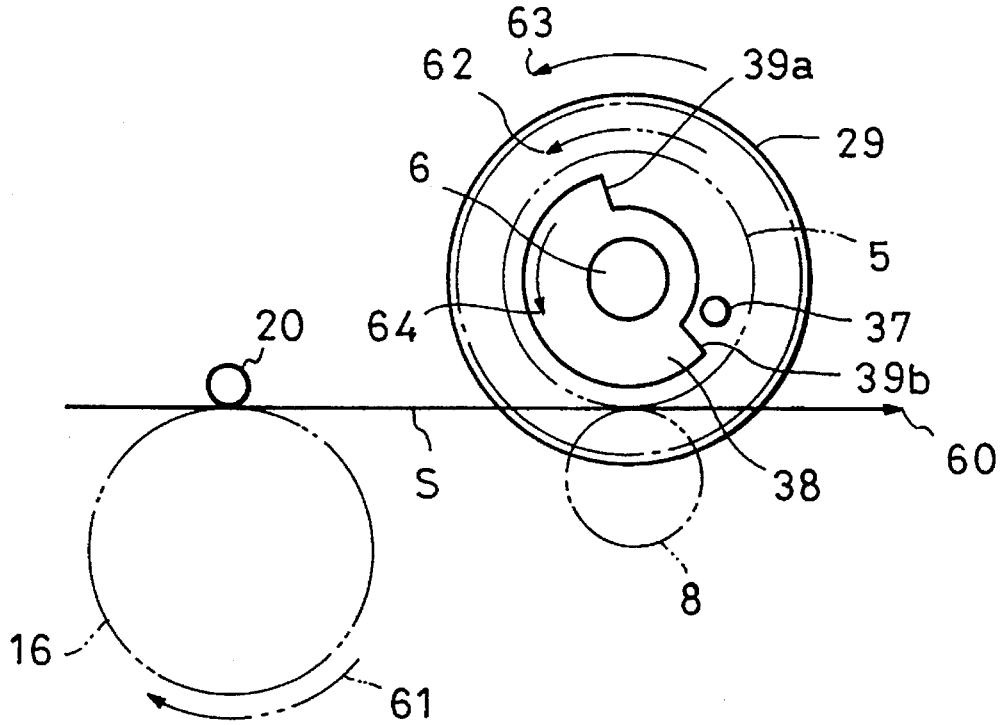

The range of the non-connection region 39, shown in FIGS. 4(*a*) and 4(*b*) , is selected so that even if the pin 37 is maintained in contact with a portion 39*a* of the cut ring 38 defining one end of the non-connection region 39 at the start of sheet feeding, it can be brought into contact with a portion 39*b* defining the other end of the non-connection region 39 to enable rotation of auxiliary transport rollers 5 to start before a leading end of sheet S transported by the feed rollers 3 enters the nip between the auxiliary transport rollers 5 and the pinch rollers 8.

In the above-described embodiment, the pin 37 is fixed to the auxiliary roller gear 29 while the cut ring 38 is fixed to the shaft 6. Alternatively, the pin 37 may be attached to the shaft 6 and the cut ring 38 may be attached to the auxiliary roller gear 29.

In the above-described embodiment, the sheet feeder unit 1 and the recording unit 14 are driven with the same motor M1 through the gear 27. However, the arrangement may alternatively be such that the gear 27 is removed and a motor M2 is connected to a shaft 40 of the gear 28 and motor M2 is controlled by the controller 50 together with motor M1 to perform the same sheet transporting operation.

Referring to FIGS. 4(*a*) and 4(*b*) which are cross-sectional views of the cut ring 38, if the peripheral speed 55 of the transport roller 16 is $V_1$ and the peripheral speed 56 of the auxiliary transport rollers 5 is $V_2$, the number of teeth of each of the gears 26, 27, 28, and 29 shown in FIG. 2 and the outside diameter of the auxiliary rollers 5 are selected so that $V_1<V_2$. The peripheral speed of the auxiliary rollers 5 is to a speed higher than that of the transport roller 16 for the following reasons.

(1) Slippage between the auxiliary rollers 5 and sheet S under a normal sheet load is anticipated. Incidentally, the pressing force of the plate springs 7 is set to a magnitude such that the sheet is not bent due to this slippage.

(2) Sheet S is moved at a speed higher than the peripheral speed of the transport roller 16 in order to reduce slippage between the transport roller 16 and sheet S under the sheet load.

In a state such as that shown in FIG. 4(*a*) where sheet S is transported in the normal direction, the speed 57 of the sheet is the same as the peripheral speed 55 of the transport roller 16, i.e., $V_1$. If the pin 37 is not in contact with the end portion 39*b* and if the auxiliary transport rollers 5 follow the movement of sheet S, the peripheral speed 56 of the auxiliary transport rollers 5 is also $V_1$.

Since the rotational angular velocity 58 of the gear 29 is selected so that the peripheral speed 56 of the auxiliary transport rollers 5 is $V_2$, the relationship between the angular velocity 59 of the cut ring 38 and the angular velocity 58 of the pin 37 embedded in the gear 29 is such that pin angular velocity 58 is greater than cut ring angular velocity 59. Therefore, the pin 37 is always brought into contact with the end portion 39*b* of the non-connection region 39 of the cut ring 38, and the auxiliary transport rollers 5 cause sheet S to move at the speed $V_2$.

In a state such as that shown in FIG. 4(*b*), where sheet S is transported in the reverse direction, the speed 60 of sheet S is the same as the peripheral speed 61 of the transport roller 16, i.e., $V_1$. Accordingly, the peripheral speed 62 of the auxiliary transport rollers 5 is equalized to $V_1$ through sheet S. Since the angular velocity 63 of the pin 37 is selected so that the peripheral speed 62 of the auxiliary transport rollers 5 is $V_2$, the relationship between the angular velocity 64 of the cut ring 38 and the angular velocity 63 of the pin 37 is such that pin angular velocity 63 is greater than cut ring angular velocity 64, and the pin 37 moves away from the end portion 39*b*.

Figure 6:
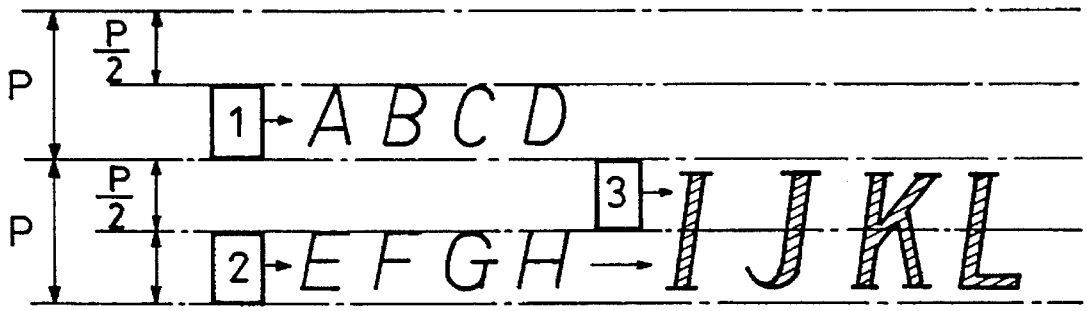
FIG. 6 is a diagram of a printing mode of the recording apparatus.

To print enlarged characters as shown in FIG. 6, sheet S is transported in the reverse direction by P/2. If P shown in FIG. 6 is 4.23 mm, the extent of transport is P/2, i.e., 2.12 mm. The range of the non-connection region 39 is selected so that even if the auxiliary transport rollers 5 are stopped, the pin 37 does not contact the end portion 39*a* of the cut ring 38 even during a shift of the outer circumference of the auxiliary transport rollers 5 by 2.12 mm.

Since forward feeding an amount greater than P is necessarily performed after reverse feeding, the pin 37 is again brought into contact with the end portion 39*b*. During the above-described reverse feeding, sheet S is transported with the transport accuracy of the transport roller 16 because the auxiliary transport rollers 5 follow the movement of sheet S. It is thereby possible to prevent formation of a black or white line.

The body 2 of the sheet feeder unit 1 is constructed so as to be detachably attached to the body 15 of the recording unit 14. The gears 27 and 28, the auxiliary roller gear 29, the gear 30, the feed roller gear 31, the feed rollers 3, the auxiliary transport rollers 5, the pinch rollers 8 and other members, shown in FIG. 2, are provided in the body 2 of the sheet feeder unit 1.

The body 2 of the sheet feeder unit 1 is attached to the body 15 of the recording unit 14 when automatic feeding of sheet S is performed. If the sheet feeder unit 1 is not attached, a sheet is manually inserted in the direction of the arrow 70. The inserted sheet is transported along the outer circumference of the transport rollers 16, and printing information is recorded on the sheet by the recording head 23. The sheet is thereafter discharged by being guided by the platen 18.

Figure 3:
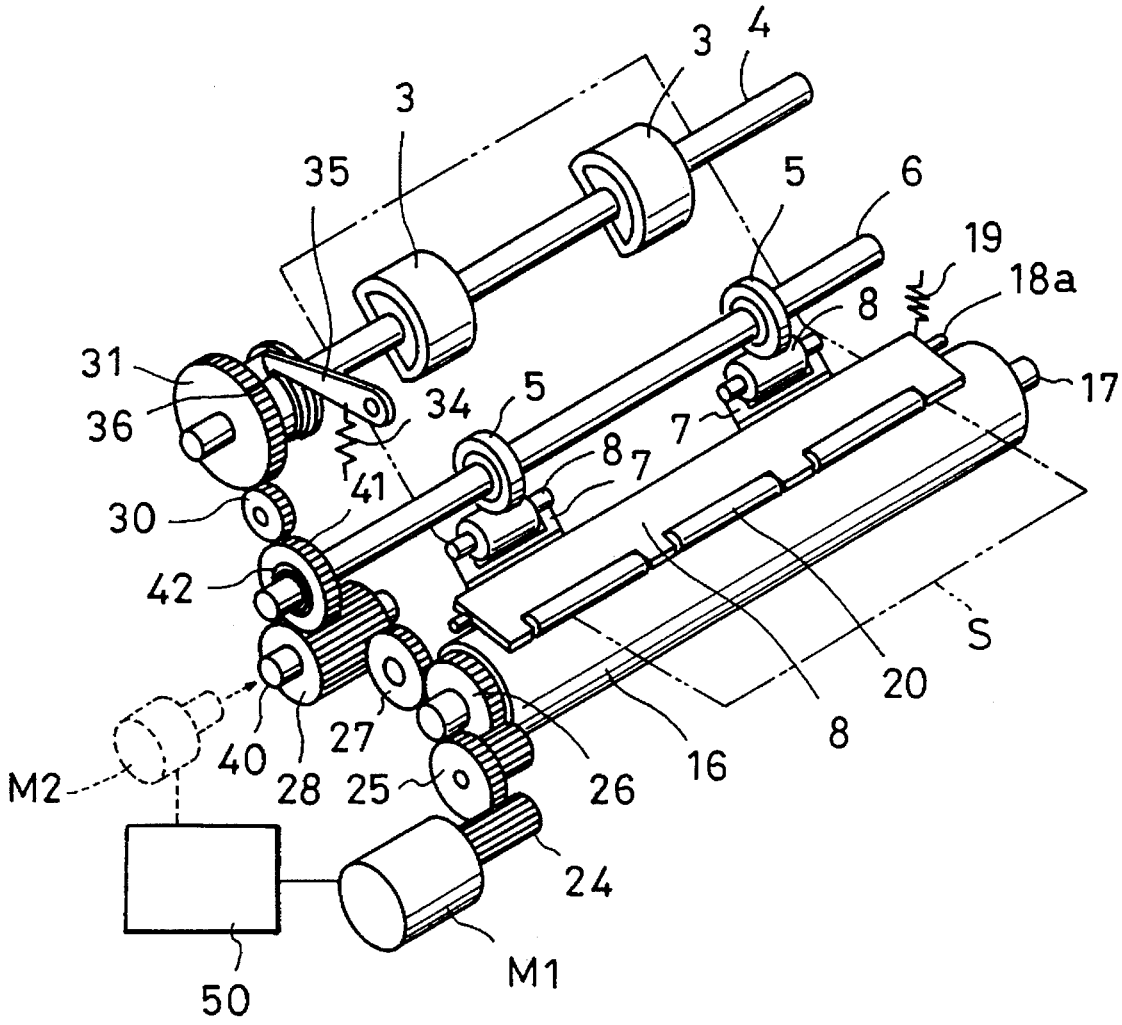
FIG. 3 is a longitudinal cross-sectional view of a recording apparatus in accordance with a second embodiment of the present invention.

FIG. 3 is schematic illustration of a sheet transport mechanism of a recording apparatus in accordance with a second embodiment of the present invention. The same components or components having the same functions as the components shown in FIGS. 1 and 2 are designated with the same reference characters.

This embodiment differs from the above-described embodiment in that an auxiliary roller gear 41 is connected to the shaft 6 through a one-way clutch 42 which transmits a torque of the auxiliary roller gear 41 in the normal transporting direction to the auxiliary roller through the shaft 6 but does not transmit any torque in the reverse direction.

Figure 5A:
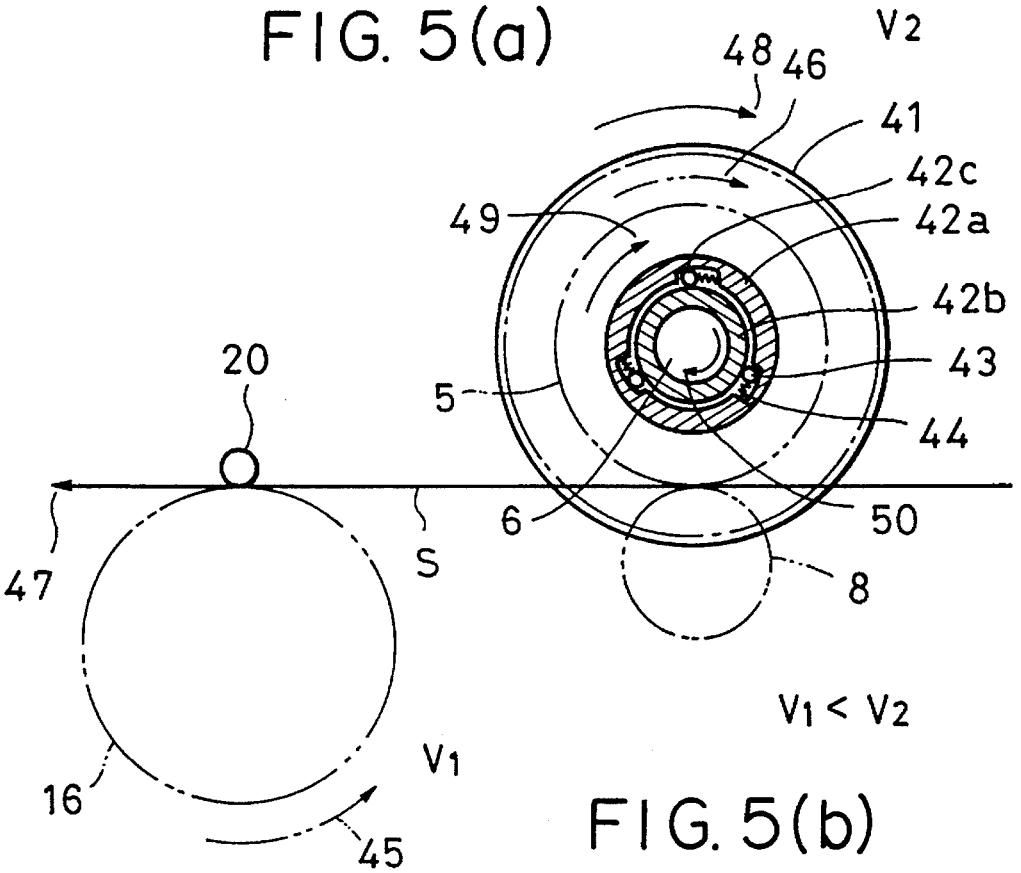
FIGS. 5(*a*) and 5(*b*) are schematic side views of the auxiliary transport roller, the cut ring and the transport roller in accordance with the second embodiment.
Figure 5B:
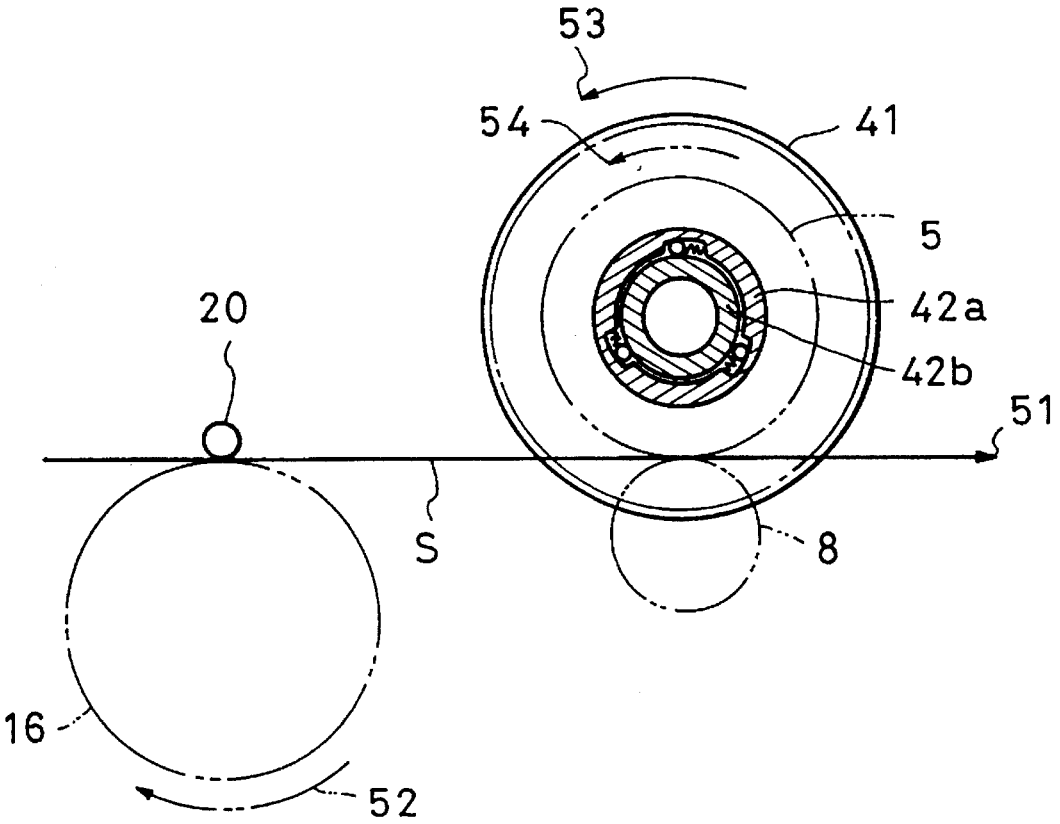

FIGS. 5(*a*) and 5(*b*) are cross-sectional views of the one-way clutch 42. Taper grooves 42C are formed in an outer ring 42*a* fixed on the auxiliary roller gear 41. A plurality of pin rollers 43 and springs 44 for urging the pin rollers in a direction along the taper grooves 42C are provided between an inner ring 42*b* to which the shaft 6 is fixed and the taper grooves 42C.

Assuming that the peripheral speed 45 of the transport roller 16 is $V_1$ and the peripheral speed 46 of the auxiliary transport rollers 5 is $V_2$, the number of teeth of each of the gears 26, 27, 28, and 41 shown in FIG. 3 and the outside diameter of the auxiliary rollers 5 are selected so that $V_1<V_2$. Under this condition, in a state such as that shown in FIG. 5(*a*) where sheet S is transported in the normal direction, slippage occurs between the sheet and the auxiliary transport rollers 5 and the speed 47 of the sheet is equal to the peripheral speed 45 of the transport roller 16, i.e., $V_1$.

Accordingly, the peripheral speed 46 of the auxiliary transport rollers 5 is also equalized to $V_1$ through sheet S. The rotational angular velocity 48 of the gear 41 is selected so that the peripheral speed 46 of the auxiliary transport rollers 5 is $V_2$, the relationship between the angular velocity 49 of the outer ring 42*a* of the one-way clutch 42 and the angular velocity 50 of the inner ring 42*b* is such that outer ring angular velocity 49 is greater than inner ring angular velocity 50. The roller pins move closer to the taper grooves 42C thereby and by the urging force of the springs 44. The driving force of the auxiliary roller gear 41 is thereby transmitted to the shaft 6, and the auxiliary transport rollers 5 cause sheet S to move at the speed $V_2$. In a state such as that shown in FIG. 5(*b*) where sheet S is moved in the reverse direction, the speed 51 of the sheet is equal to the peripheral speed 52 of the transport roll 16, i.e., $V_1$. The rotational angular velocity 53 of the gear 41 is greater than the rotational angular velocity 54 of the auxiliary transport rollers 5. Therefore, the outer ring 42*a* and the inner ring 42*b* of the one-way clutch 42 operate so that the roller pins 43 move out of the taper 42C, and the driving force of the auxiliary roller gear 41 is not transmitted.

In this state, sheet S is transported with the transport accuracy of the transport roller 16 because the auxiliary transport rollers 5 follow the movement of sheet S.

In the above-described embodiments, auxiliary transport rollers 5 are provided on the sheet feeder unit 1. Alternatively, auxiliary transport rollers 5 may be provided in the printing/transport unit 14. A plurality of stages of auxiliary transport rollers 5 may be provided if necessary. If the sheet feeder unit 1 is unnecessary, recording sheets may be inserted from the position of auxiliary transport rollers 5.

In accordance with the present invention, as described above, auxiliary transport rollers are arranged to follow movement of a sheet when the sheet is reversely transported by the reverse rotation of the transport roller. It is thereby possible to provide an improved printing apparatus in which the sheet feeding angle in the sheet feeder unit can be freely set, which can be reduced in-overall size, and which is free from occurrence of defects such as white and black lines in a sheet-transporting printing mode.

Figure 7:
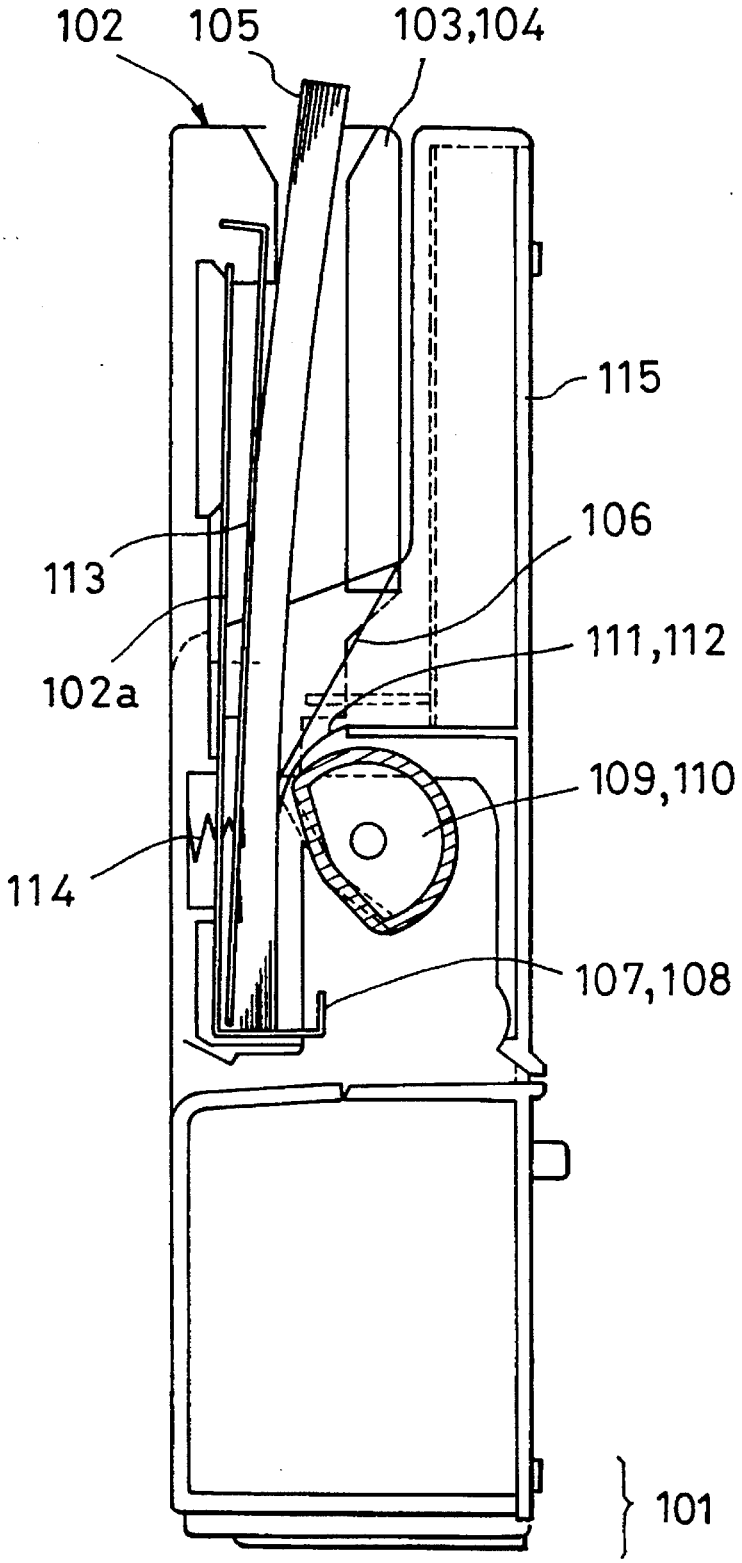
FIG. 7 is a schematic longitudinal sectional view of an automatic sheet feeder unit of a third embodiment in a recording sheet setting state.
Figure 8:
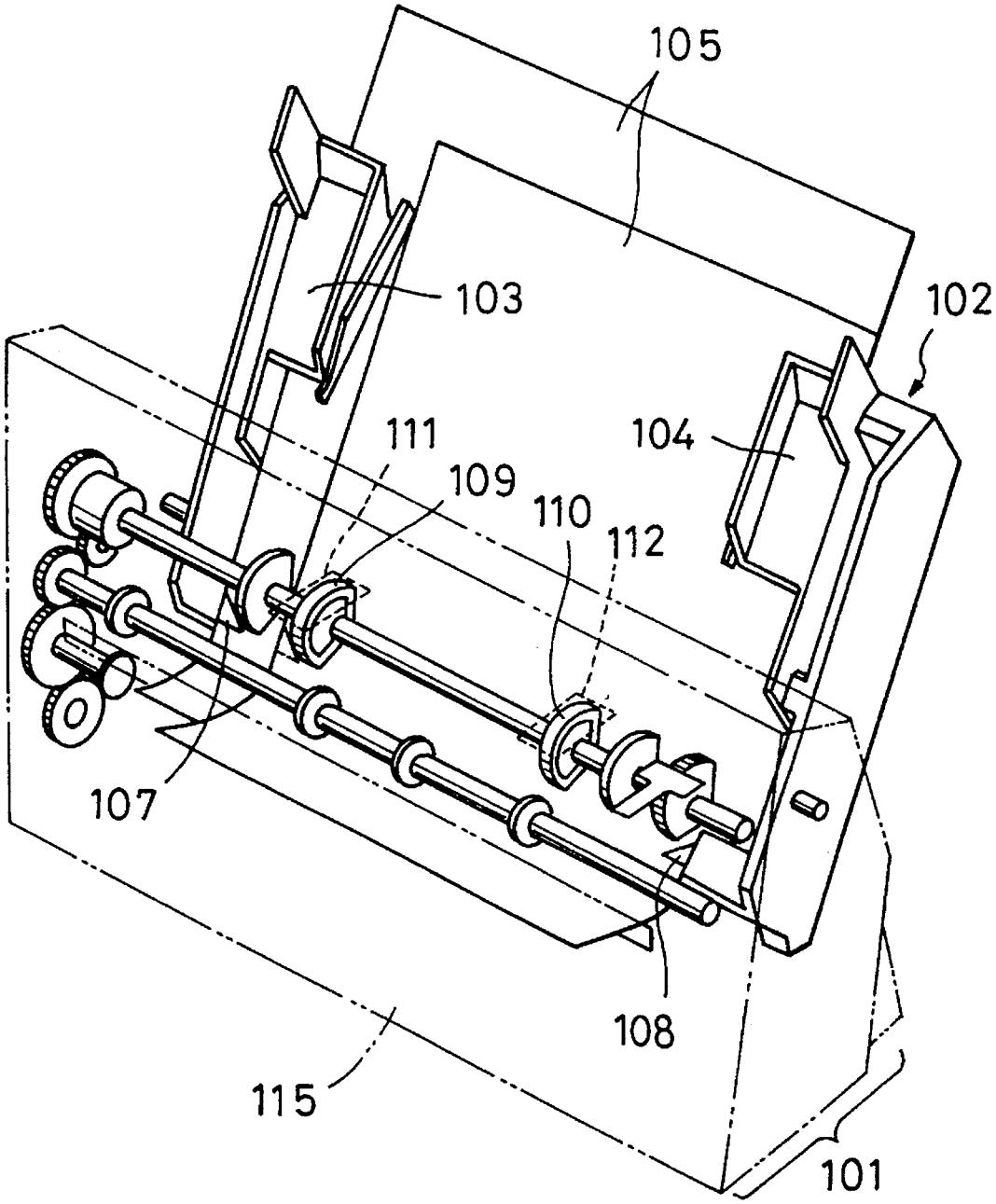
FIG. 8 is a schematic perspective view of the automatic sheet feeder unit of the third embodiment in a recording sheet setting state.

A third embodiment of the present invention will be described below with reference to FIGS. 7 and 8. FIG. 7 is a cross-sectional view of an automatic sheet feeder unit suitable for carrying out the invention at the time of recording sheet setting, and FIG. 8 is a perspective view of the automatic sheet feeder unit.

Recording sheets 105 are stacked in a sheet feeder tray 102 of the automatic sheet feeder unit 101. Sheet width guides 103 and 104 for limiting movement of recording sheets 105 in the widthwise direction are slidably attached to the sheet feeder tray 102. Each of the sheet width guides 103 and 104 is formed so as to extend over the sheets to serve as a member for roughly guiding the sheets with respect to the direction of thickness of the sheets.

Separating claws 107 and 108 are provided on lower end portions of the sheet width guides 103 and 104. Recording sheets 105 passing through the sheet width guides 103 and 104 are guided by a pressure plate 113 attached to the sheet feeder tray 102 pressed by springs 114 and a sheet number limiting guide 106 formed integrally with a main chassis 115 to be stacked inside the separating claws.

Roller guides 111 and 112 in the form of sheets are provided in the vicinity of feed rollers 109 and 110 attached to the main chassis 115 and on the upstream side of rollers 109 and 110. The roller guides 111 and 112 are fixed to the main chassis 115 by an adhesive or a pressure sensitive adhesive tape. The width of the roller guides 111 and 112 is equal to or greater than the width of a rubber portion of the feed rollers 109 and 110. Projecting ends of the roller guides 111 and 112 are positioned so as to be closer to the recording sheets relative to the feed rollers 109 and 110. Each of the roller guides 111 and 112 is formed of a thin sheet of an elastic material having a low coefficient of friction (e.g., high-polymer polyethylene, polyethylene terephthalate or the like).

Even if the recording sheets 105 passing through the sheet number limiting guide 106 are bent from a suitable position toward the feed rollers 109 and 110, there is no possibility of the feed rollers 109 and 110 rotating from frictional force with recording sheets 105, because the recording sheets 105 contact the feed rollers 109 and 110 through the roller guides 111 and 112. Thus, the recording sheets 105 can be set smoothly and reliably.

When the sheet feeder tray 102 is closed, the pressure plate 113 is stopped by an unillustrated lock mechanism after being moved to a position on a bottom 102*a* of the sheet feeder tray 102 against the urging force of the springs 114. A space is thereby created between the pressure plate 113 and sheet number limiting guide 106 to allow recording sheets 105 to be inserted.

At the time of sheet feeding, the pressure plate 113 is released from the locked state by an unillustrated release means such as a release button, or the operation of the lock mechanism is cancelled by interlocking with the operation of moving the sheet feeder tray 102.

Figure 9:
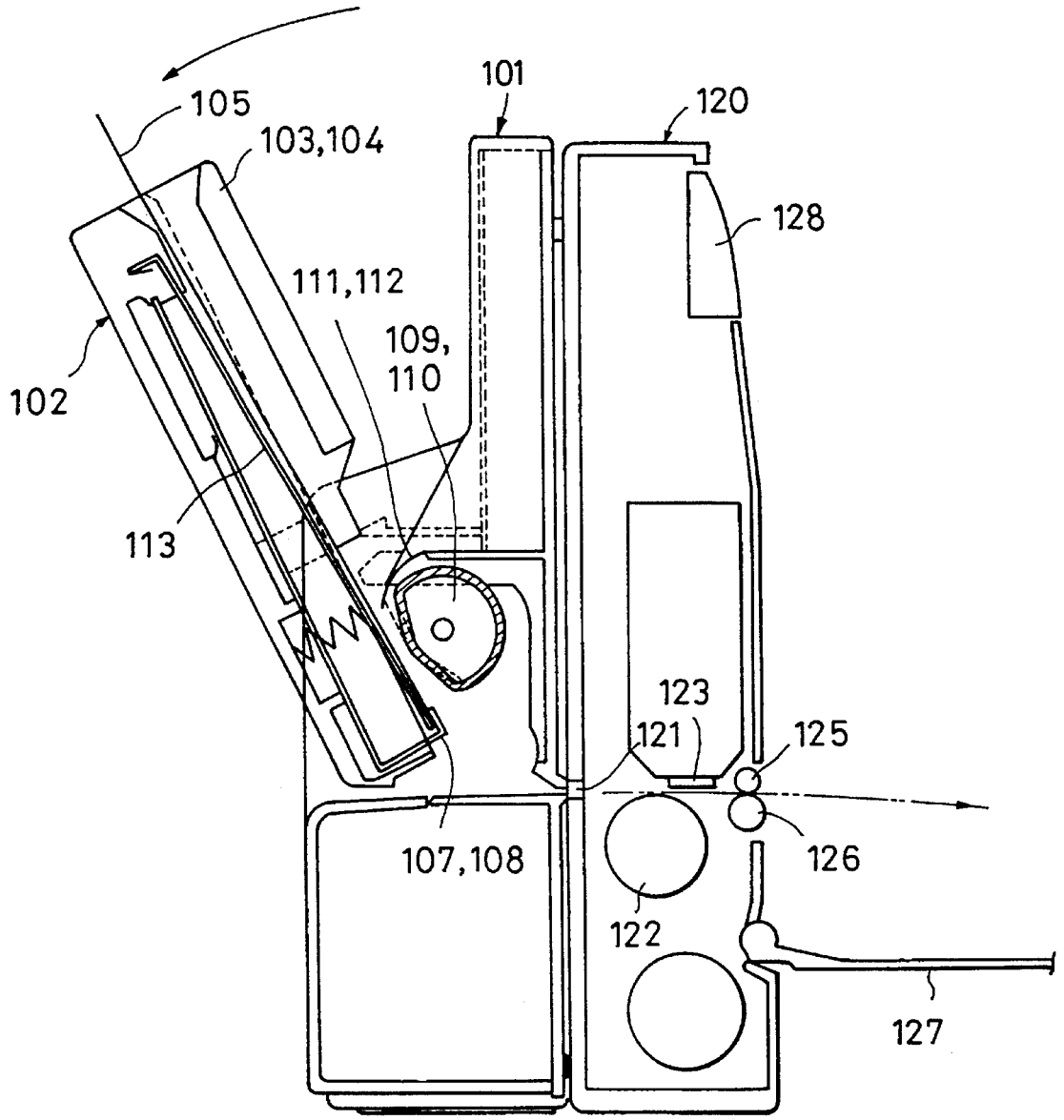
FIG. 9 is a schematic longitudinal sectional view of the automatic sheet feeder unit of the third embodiment in a recording sheet feeding state.

FIG. 9 is a cross-sectional view of the automatic sheet feeder unit at the time of feeding recording sheets 105.

At this time, the sheet feeder tray 102 is open. In this state, the feed rollers 109 and 110 are driven and rotated to supply the uppermost recording sheet. At this time, it does not matter whether the roller guides 111 and 112 are in contact or not in contact with the feed rollers 109 and 110. Even if the roller guides are in contact with the feed rollers, the sliding load upon the feed rollers 109 and 110 is negligible since the weight of the roller guides 111 and 112 is small and the coefficient of friction is also small.

A "NORSOREX" (registered trademark) or EPDM rubber is ordinarily used as the rubber material of the feed rollers 109 and 110. If the light-proof property of the rubber material of the feed rollers under ultraviolet rays introduced when the sheet feeder tray is opened is a consideration, the roller guides 111 and 112 may be formed of a material having a low transmissivity to prevent deterioration of the rubber.

A recording unit 120 (shown in FIG. 9) for recording an image on each recording sheet supplied from the automatic feeder unit 101 is integral with or detachably attached to the automatic sheet feeder unit 101.

Recording sheet 105 introduced into the recording unit 120 through a sheet inlet 121 is transported along a platen roller 122. During the passage of the recording sheet through a recording section facing a recording head 123, an image is recorded on the recording sheet. The recording sheet is then discharged onto a sheet discharge tray 127 by sheet discharge rollers 125 and 126.

The recording head 123 is an ink jet type head which ejects ink through an ejection nozzle to perform recording by utilizing a change in pressure caused by growth and collapse of a film boiling bubble caused by thermal energy applied from an electrothermal conversion element to eject ink.

The recording head 123 is therefore provided with an ink tank and electrothermal conversion elements for generating thermal energy.

As illustrated, an operation panel 128 having switches and a display is also provided.

Figure 10:
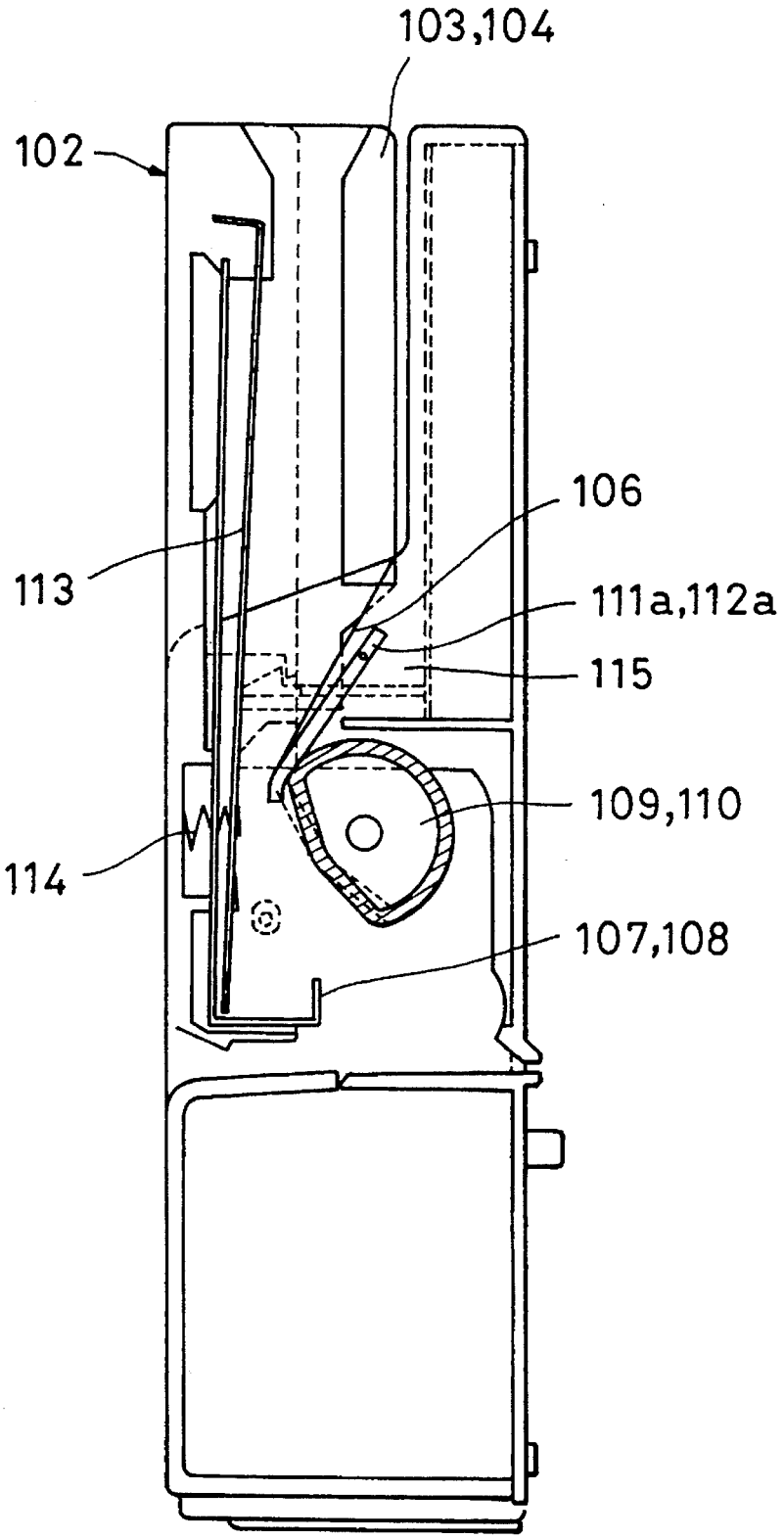
FIG. 10 is a schematic longitudinal sectional view of an automatic sheet feeder unit of a fourth embodiment in a recording sheet setting state.
Figure 11:
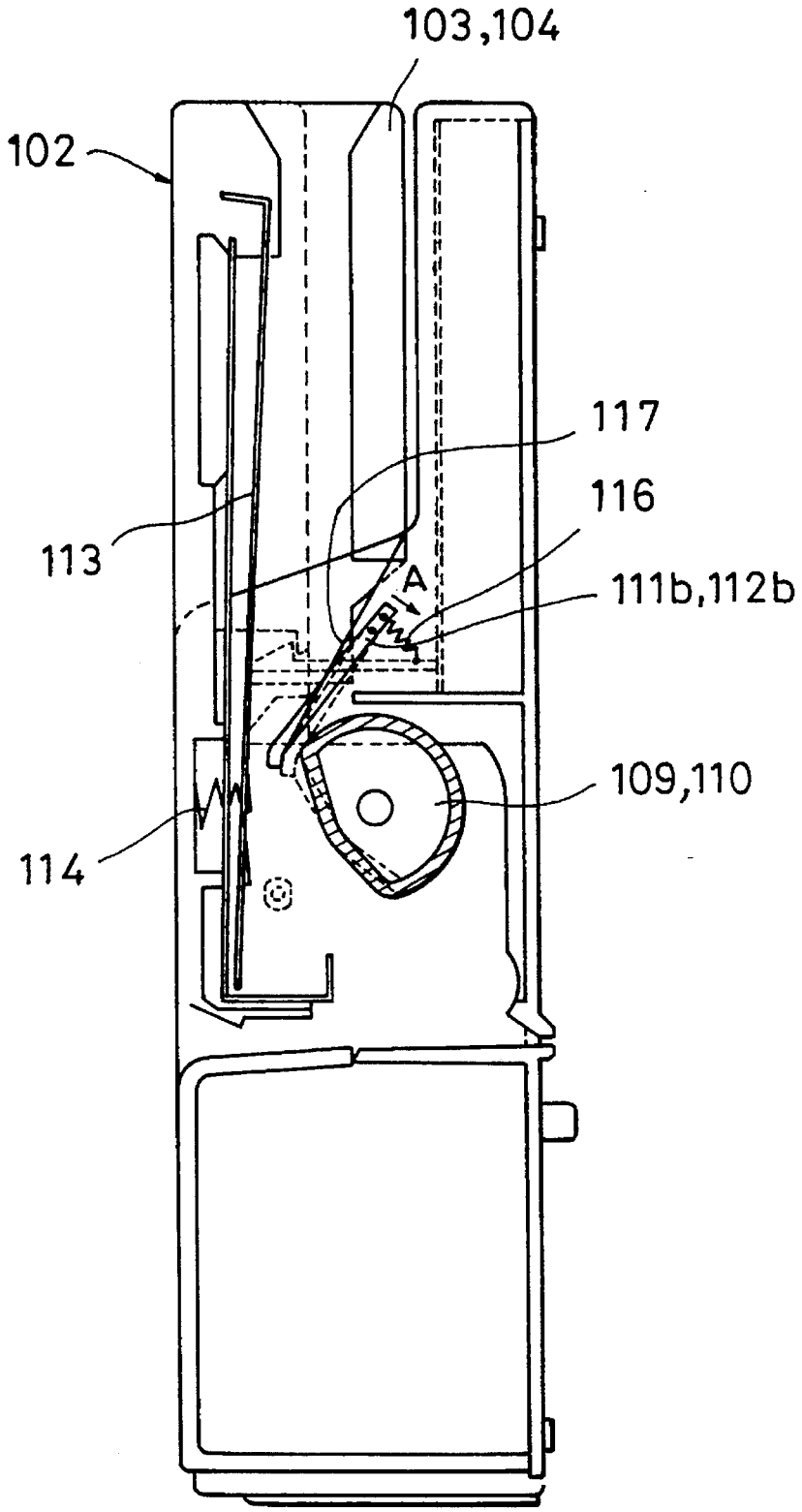
FIG. 11 is a schematic longitudinal sectional view of an automatic sheet feeder unit of a fifth embodiment in a recording sheet setting state.

FIG. 10 shows an automatic sheet feeder unit in accordance with a fourth embodiment of the invention having a solid member used as each roller guide of the third embodiment.

Roller guides 111*a* and 112*a* are axially supported on a main chassis 115 so as to be rotatable, and are urged into contact with feed rollers 109 and 110 by virtue of their own weight. The contact caused by the weight entails no problem since the load upon each of the feed rollers 109 and 110 thereby imposed is small.

FIG. 10 shows a feeder structure in which roller guides in accordance with the fourth embodiments are brought into contact with feed rollers 109 and 110 only when recording sheets are set. That is, the roller guides do not contact the feed rollers 109 and 110 during sheet feeding, and the feed rollers can supply recording sheets in a non-load condition.

Roller guides 111*b* and 112*b* are axially supported on a main chassis 115 so as to be rotatable and are urged by a spring 116 in the direction of arrow A. The urged roller guides 111*b* and 112*b* are maintained by a stopper 117 out of contact with the feed rollers 109 and 110. When recording sheets are set, the roller guides 111*b* and 112*b* are pressed against the sheets to bring them into contact with the feed rollers 109 and 110.

According to the present invention, as is apparent from the above description, sheet-like guide members are provided in the vicinity and upstream of the feed rollers in the automatic sheet feeder unit to prevent the feed rollers from rotating by contacting recording sheets and following the movement of the recording sheets. The handling at the time of sheet setting is thereby improved.

Also, the feed rollers are shielded from light to cover the light-sensitive properties of the rubber of the feed rollers. It is thereby possible to provide an automatic sheet feeder having improved sheet feeding performance.

While the present invention has been described with respect to what presently are considered to be the preferred embodiments, it is to be understood that the invention is not limited to the disclosed embodiments. To the contrary, the present invention is intended to cover various modifications and equivalent arrangements included within the spirit and scope of the appended claims.

What is claimed is:

1. A sheet transport apparatus comprising:

transport means for transporting a sheet in a predetermined direction and a direction reverse to the predetermined direction;

a rotating member contactable with the sheet upstream of said transport means;

a drive source; and drive transmission means for transmitting a driving force from said drive source to said rotating member to transport the sheet in the predetermined direction when said transport means is transporting the sheet in the predetermined direction, and transmitting no driving force from the drive source when said transport means is transporting the sheet in the reverse direction, wherein said rotating member to which no driving force is transmitted is rotatable by a force from the sheet being transported in the reverse direction.

2. A sheet transport apparatus according to claim 1, wherein said transport means further comprises a roller which rotates while contacting the sheet.

3. A sheet transport apparatus according to claim 1, wherein said drive transmission means further comprises a one-way clutch.

4. A sheet transport apparatus according to claim 1, further comprising pressing means for pressing the sheet against said rotating member.

5. A sheet transport apparatus according to claim 1, wherein said drive transmission means further comprises a first engagement member rotatable in synchronization with said drive source, and a second engagement member engaging with said first engagement member and receiving a driving force from said first engagement member for transmission to said rotating member.

6. A sheet transport apparatus according to claim 5, wherein said first engagement member is freely rotatable relative to said second engagement member through a predetermined rotational angle.

7. A sheet transport apparatus according to claim 6, wherein one of said first and second engagement members engages with the other engagement member by one of first and second engaging portions in accordance with the rotating direction, and wherein if the rotating direction is changed during engagement, said one of the engagement members engages with the other engagement member by the other engaging portion after said first engagement member has rotated through a predetermined angle.

8. A sheet transport apparatus according to claim 1, further comprising:

a first body for housing said transport means and said drive source; and a second body for housing said rotating member and said drive transmission means, said second body detachably secured to said first body.

9. A sheet transport apparatus according to claim 1, further comprising image formation means for forming an image on the sheet transported by said transport means.

10. A sheet transport apparatus according to claim 9, wherein said image formation means comprises an ink jet head.

11. A sheet transport apparatus according to claim 10, wherein said ink jet head ejects ink by a bubble generated by thermal energy.

12. A sheet transport apparatus according to claim 9, further comprising:

a first body for housing said transport means, said drive source and said image formation means; and a second body for housing said rotating member and said drive transmission means, said second body detachably mounted to said first body.

13. A sheet transport apparatus according to claim 12, further comprising:

a tray on which sheets are stacked; and supply means for supplying each of sheets stacked on said tray to said rotating member, said tray and said supply means being provided in said second body.

14. A sheet transport apparatus according to claim 9, wherein said image formation means forms an image having a first predetermined length along the sheet transport direction.

15. A sheet transport apparatus according to claim 14, wherein said transport means transports the sheet through a second predetermined length each time said image formation means forms an image having the first predetermined length.

16. A sheet transport apparatus according to claim 15, wherein the sheet is reversely transported through the first predetermined length by said transport means after the image formation means has formed an image having the first predetermined length on the sheet, and an image is then formed by said image formation means, whereby an image having a length not smaller than said first predetermined length is formed.

17. A sheet transport apparatus according to claim 16, wherein the image formed after the sheet has been reversely transported through the first predetermined length is contiguous to the image formed immediately before that.

18. A sheet transport apparatus according to claim 16, wherein said rotating member is caused to rotate by a force from the sheet while the sheet is being reversely transported by said transport means.

19. A sheet transport apparatus comprising:

a drive source for generating torque in a first direction and torque in a second direction reverse to the first direction;

transport means for transporting a sheet in a forward direction by receiving the torque in said first direction from said drive source, and for transporting the sheet in a reverse direction by receiving the torque in the second direction from said drive source;

a rotating member being rotatable and contactable with the sheet transported by said transport means; and drive transmission means for transmitting the torque from said drive source in the first direction to rotate said rotating member so as to transport the sheet in the forward direction, and transmitting no torque so not to transport the torque of said driving source in the second direction, wherein said rotating member to which no torque is transmitted is rotatable by a force from the sheet being transported in the reverse direction.

20. A sheet transport apparatus according to claim 19, wherein said transport means further comprises a roller which rotates while contacting the sheet.

21. A sheet transport apparatus according to claim 19, wherein said drive transmission means further comprises a first engagement member rotatable in synchronization with said drive source, and a second engagement member engaging with said first engagement member and receiving a driving force from said first engagement member for transmission to said rotating member.

22. A sheet transport apparatus according to claim 21, wherein said first engagement member is freely rotatable relative to said second engagement member through a predetermined rotational angle.

23. A sheet transport apparatus according to claim 22, wherein one of said first and second engagement members engages with the other engagement member by one of first and second engaging portions in accordance with the rotating direction, and wherein if the rotating direction is changed during engagement, said one of the engagement members engages with the other engagement member by the other engaging portion after said first engagement member has rotated through a predetermined angle.

24. A sheet transport apparatus according to claim 19, further comprising:

a first body for housing said transport means and said drive source; and a second body for housing said rotating member and said drive transmission means, said second body detachably mounted to said first body.

25. A sheet transport apparatus according to claim 19, further comprising image formation means for forming an image on the sheet transported by said transport means.

26. A sheet transport apparatus according to claim 25, wherein said image formation means comprises an ink jet head.

27. A sheet transport apparatus according to claim 26, wherein said ink jet head ejects ink by a bubble generated by thermal energy.

28. A sheet transport apparatus according to claim 27, further comprising:

a first body for housing said transport means, said drive source and said image formation means; and a second body for housing said rotating member and said drive transmission means, said second body detachably mounted to said first body.

29. A sheet transport apparatus according to claim 28, further comprising:

a tray on which sheets are stacked; and supply means for supplying each of sheets stacked on said tray to said rotating member, said tray and said supply means being provided in said second body.

30. A sheet transport apparatus according to claim 25, wherein said image formation means forms an image having a first predetermined length along the sheet transport direction.

31. A sheet transport apparatus according to claim 30, wherein said transport means transports the sheet through a second predetermined length each time said image formation means forms an image having the first predetermined length along the sheet transport direction.

32. A sheet transport apparatus according to claim 31, wherein the sheet is reversely transported through the first predetermined length by said transport means after the image formation means has formed an image having the first predetermined length on the sheet, and said image formation means further forms an image, whereby it is possible to form an image having a length not smaller than said first predetermined length.

33. A sheet transport apparatus according to claim 32, wherein the image formed after the sheet has been reversely transported through the first predetermined length is contiguous to the image formed immediately before that.

34. A sheet transport apparatus according to claim 32, wherein said rotating member is caused to rotate by a force from the sheet while the sheet is being reversely transported by said transport means.

35. A sheet transport apparatus comprising:

transport means for transporting a sheet in a predetermined direction and a direction reverse to said predetermined direction;

a rotating member which is in contact with the sheet transported by said transport means;

a drive source;

drive transmission means which, when said transport means transports the sheet in the predetermined direction, transmits a driving force from said drive source to said rotating member in order to rotate said rotating member such that the sheet is transported in the predetermined direction, and which, when said transport means transports the sheet in the direction reverse to said predetermined direction, transmits no driving force from said drive source, said rotating member being rotatable by a force from the sheet when it is being transported in the direction reverse to said predetermined direction;

image formation means for forming an image having a predetermined length along the sheet transport direction on the sheet transported by said transport means, wherein said image formation means transports the sheet reversely through the first predetermined length by said transport means, and said image formation means further forms an image after said image formation means has formed an image having the first predetermined length on the sheet, whereby an image having a length not smaller than said first predetermined length is formed along the sheet transport direction.

36. A sheet transport apparatus according to claim 35, wherein the image formed after the sheet has been reversely transported through the first predetermined length is contiguous to the image formed immediately before that.

37. A sheet transport apparatus according to claim 35, wherein said transport means transports the sheet through a second predetermined length each time said image formation means forms an image having the first predetermined length along the sheet transport direction.

* * * * *

UNITED STATES PATENT AND TRADEMARK OFFICE

CERTIFICATE OF CORRECTION

PATENT NO. : 5,480,132
DATED : January 2, 1996
INVENTOR(S) : TAKEHIKO KIYOHARA, ET AL.

It is certified that error appears in the above-indentified patent and that said Letters Patent is hereby corrected as shown below: Title page

Item [63],
line RUSAD, "June 3, 1994," should read --June 3, 1993,--.

Column 1,
line 5, "June 3, 1994," should read --June 3, 1993,--;
line 51, "line" (first occurrence) should read --lines--; and
line 52, "reduce" should read --reduces--.

Column 2,
line 64, "These" should read --There--.

Column 12,
line 40, "direction;" should read --direction; and--.

Signed and Sealed this
Second Day of July, 1996

*Attest:*

*Attesting Officer*

BRUCE LEHMAN

*Commissioner of Patents and Trademarks*